US007134314B1

(12) United States Patent
Peterson et al.

(10) Patent No.: US 7,134,314 B1
(45) Date of Patent: Nov. 14, 2006

(54) HYDRAULIC TOOL AUTOMATIC ADJUSTING DIE HOLDER

(75) Inventors: Jennifer M. Peterson, Manchester, NH (US); Thomas R. Faucher, Manchester, NH (US); John D. Lefavour, Litchfield, NH (US); Shane M. Hopps, Whitefield, NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/213,093

(22) Filed: Aug. 26, 2005

(51) Int. Cl.
*B21J 13/04* (2006.01)
*B21D 5/02* (2006.01)
*B30B 1/34* (2006.01)

(52) U.S. Cl. ..... 72/455; 72/389.3; 100/258 R

(58) Field of Classification Search ..... 72/389.3, 72/455, 456, 453.15, 453.16; 100/258 A, 100/258 R See application file for complete search history.

(56) References Cited

U.S. PATENT DOCUMENTS 2,712,252 A 7/1955 Landis ..... 81/15
3,163,105 A * 12/1964 Pearson ..... 100/214
3,852,991 A * 12/1974 Poggio ..... 100/214
4,084,422 A * 4/1978 Zilges et al. ..... 72/265
4,612,765 A * 9/1986 Livesay ..... 72/466.8
4,873,923 A * 10/1989 Manning ..... 100/269.1
5,272,904 A * 12/1993 Krumholz ..... 72/455

OTHER PUBLICATIONS

Product Brochure "Two-Piece Spherical Washers", J. W. Winco, Inc., Dec. 29, 2004, (www.jwwinco.com/products/section11/tpsws/ ).

* cited by examiner

*Primary Examiner*—David Jones
(74) *Attorney, Agent, or Firm*—Harrington & Smith, LLP

(57) ABSTRACT

A hydraulic tool working head including a frame; a ram movably connected to the frame in a first longitudinal direction, wherein the ram is adapted to be moved relative to the frame by hydraulic fluid; and a movable member connected to a first end of the ram by an automatic adjusting connection. The movable member is adapted to move relative to the ram in a second direction perpendicular to the first direction.

19 Claims, 8 Drawing Sheets

HYDRAULIC TOOL AUTOMATIC ADJUSTING DIE HOLDER

BACKGROUND OF THE INVENTION

1. Field of the Invention

The invention relates to a hydraulic tool with a moveable member on a frame and, more particularly, to a system for automatically adjusting the moveable member relative to a ram which moves the moveable member relative to the frame.

2. Brief Description of Prior Developments

U.S. Pat. No. 2,712,252 discloses a tool for compressing electrical connectors. A die member is attached to an end of a ram by pins in an annular groove and a spring. Hydraulic tools for compressing electrical connectors or cutting electrical conductors are also known.

In a hydraulic tool for compressing or crimping an electrical connector onto a conductor, such as the conventional tool 10 shown in FIG. 1, it is desirable to keep the piston ram 12 axially aligned to the center axis of the hydraulic cylinder 14. As seen with reference to FIG. 2, during compression of a work piece 16, the C shaped head 18 of the tool's working head frame 20 can deflect or bend. If the piston ram 12 tips with the die holder 22, the piston ram will scuff and scrape the cylinder 14.

There is a desire to keep the piston ram axially aligned to the hydraulic cylinder axis to prevent the ram from tipping during compression or crimping of a connector.

SUMMARY OF THE INVENTION

An automatic adjusting system can be provided to adjust location of a die holder on a ram with both translation of the die holder and rotation of the die holder relative to the ram to adjust for deflection of a tool's crimp head and thereby prevent the ram from tipping or tilting during crimping by the tool.

In accordance with one aspect of the invention, a hydraulic tool working head is provided including a frame; a ram movably connected to the frame in a first longitudinal direction, wherein the ram is adapted to be moved relative to the frame by hydraulic fluid; and a movable member connected to a first end of the ram by an automatic adjusting connection. The movable member is adapted to move relative to the ram in a second direction perpendicular to the first direction.

In accordance with another aspect of the invention, a hydraulic tool working head is provided comprising a frame; a ram movably connected to the frame in a first longitudinal direction, wherein the ram is adapted to be moved relative to the frame by hydraulic fluid; and a movable member connected to a first end of the ram by an automatic adjusting connection. The movable member is adapted to rotate along an axis perpendicular to the first direction and translate in a second different direction.

In accordance with one method of the invention, a method of manufacturing a hydraulic tool working head is provided comprising connecting a ram to a frame, wherein the ram is adapted to be moved relative to the frame in a first longitudinal direction by hydraulic fluid; and connecting a movable member to a front end of the ram with an automatic adjusting connection, wherein the movable member is adapted to move relative to the ram in a second direction perpendicular to the first direction.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 3:
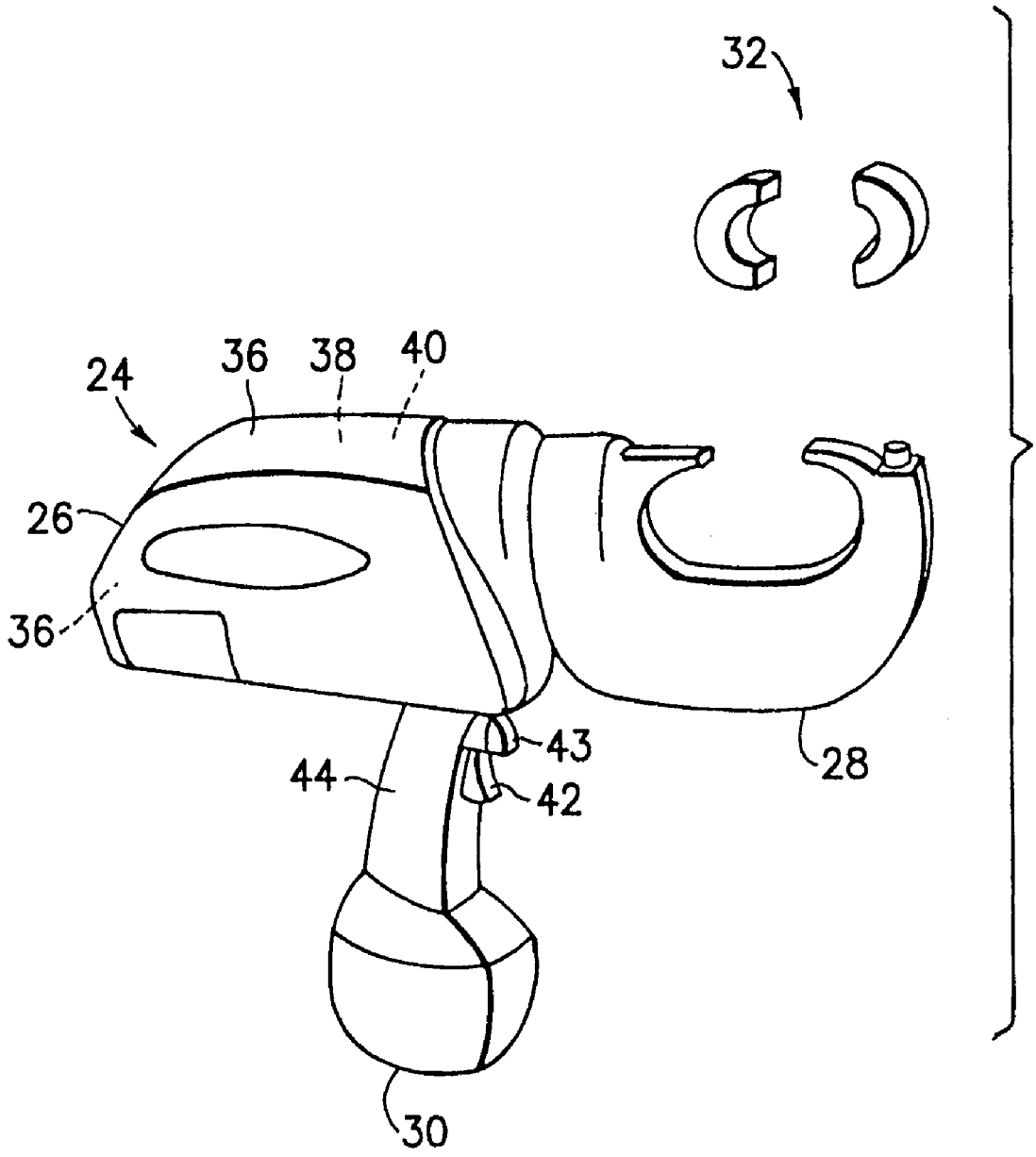
FIG. 3 is a perspective view of a hand-held, battery operated, hydraulic compression tool incorporating features of the invention.

Referring to FIG. 3, there is shown a perspective view of a tool 24 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The tool 24 is a hand-held battery operated hydraulic crimping tool. However, in alternate embodiments, features of the invention could be used in any suitable type of hydraulic tool or pneumatic tool, or tool having a movable ram. The tool 24 generally comprises a main section 26, a working head 28, and a battery 30. In this embodiment the working head 28 is adapted to receive removable crimp dies 32. However, in alternate embodiments an suitable dies could be provided including cutting dies, or the working head might have non-removable crimping or cutting sections rather than removable dies.

The main section 26 generally comprises an exterior housing 34, an electric motor 36, a hydraulic pump 38, a fluid conduit system 40 including a fluid reservoir for conduiting fluid to and from the working head 28, and a control system including user actuated triggers 42, 43. In an alternate embodiment, the main section 26 could be adapted to be connected to a remote hydraulic fluid supply by hydraulic hoses. Yet another embodiment may be adapted to a self contained manually operated hydraulic crimping tool. The housing 34 comprises a handle 44. The triggers 42, 43 are mounted on the handle. The battery 30 is removably mounted to the bottom of the handle 44. The battery comprises a rechargeable battery. In an alternate embodiment the battery might not be removable or might not be rechargeable.

Figure 4:
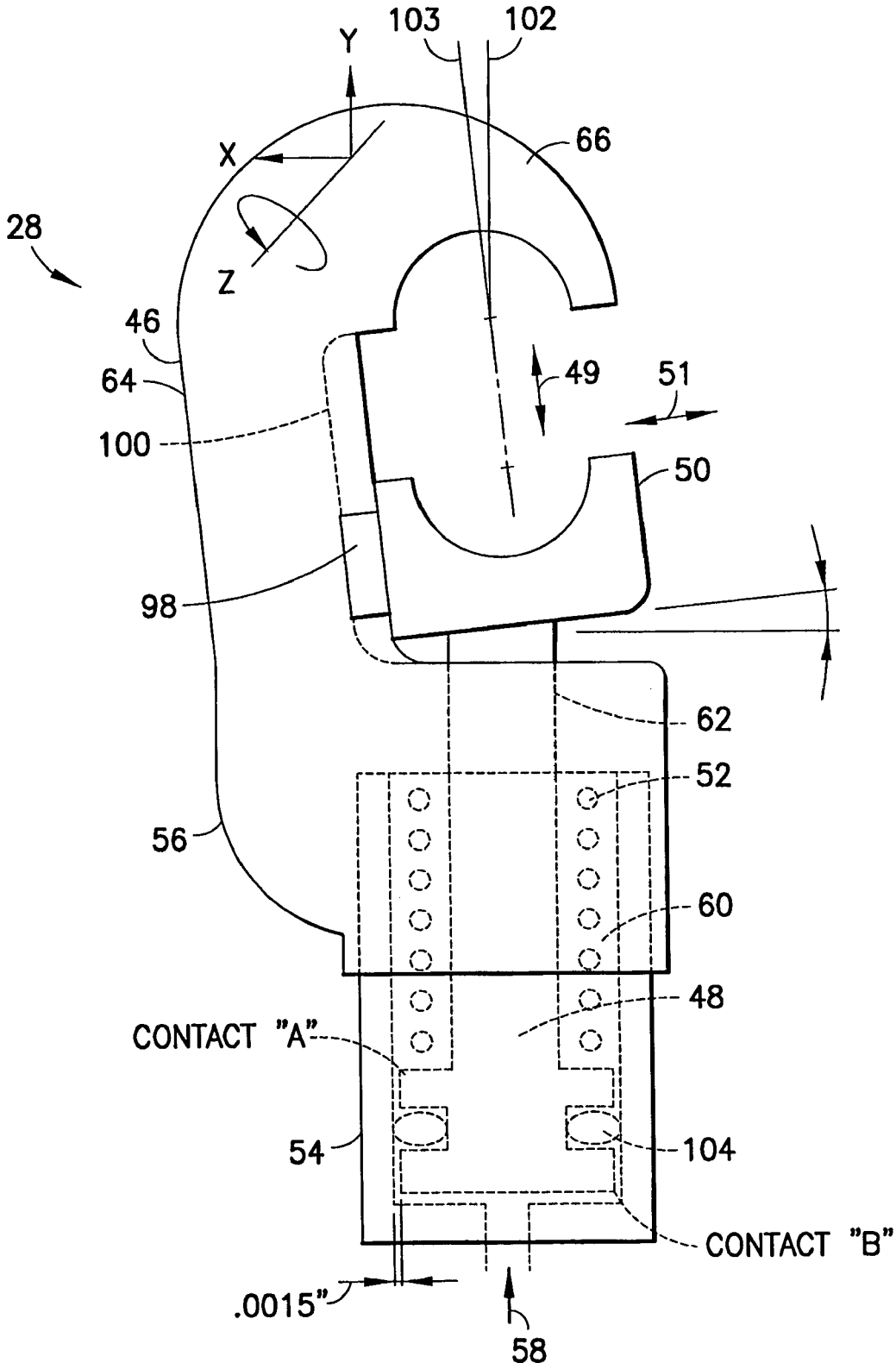
FIG. 4 is a side view of the working head of the tool shown in FIG. 3.

Referring also to FIG. 4, the working head 28 generally comprises a frame 46, a ram 48, a movable member 50 connected to the ram 48, and a spring 52. The frame 46 comprises a first frame member 54 fixedly connected to a frame of the fluid conduit system 40 and a second frame member 56. The first frame member 54 comprises an inlet/outlet aperture 58 and a ram receiving area 60. The second frame member 56 is fixedly connected to the first frame member to substantially enclose the ram receiving area 60 except at the aperture 58 and a ram hole 62 through the second frame member 56. The spring 52 is located in the ram receiving area 60. The ram 48 is movably connected to the frame in a first longitudinal direction 49, wherein the ram is adapted to be moved relative to the frame by hydraulic fluid. The spring 52 biases the ram 48 in a retracted position as shown. However, the bias of the spring can be overcome by hydraulic fluid entering the area 60 from the aperture 58.

The second frame member 56 comprises a general C shaped profile. However, in alternate embodiments other types of shapes could be provided. The bottom end of the C shaped profile is mounted to the first frame member 54. The C shaped profile comprises a side extension 64 and a top section 66. The top section 66 forms an upper die holder located opposite the ram 48. The ram 48 is adapted to move the movable member 50 towards and away from the top section 66.

Figure 5:
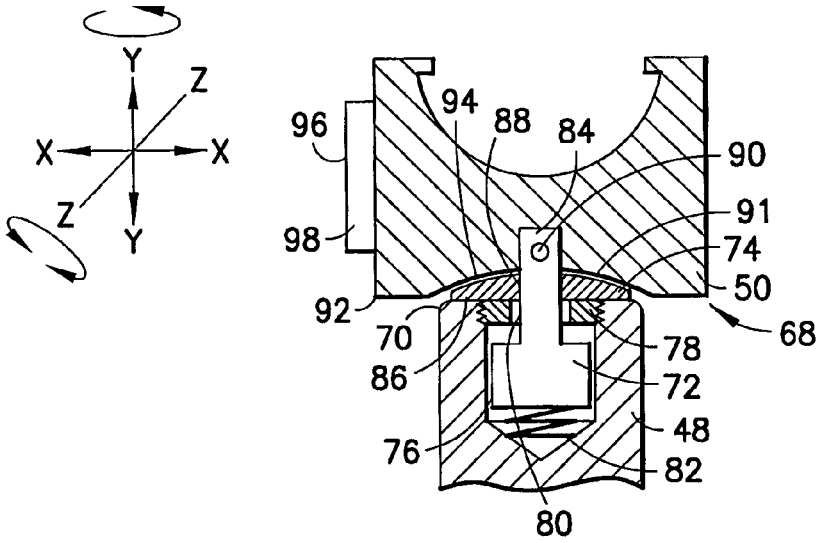
FIG. 5 is a cross sectional view of the top of the ram and the movable member shown in FIG. 4.

Referring also to FIG. 5, a connection 68 is provided between the front end 70 of the ram 48 and a rear end of the movable member 50. The connection 68 is an automatic adjusting connection. The movable member 50 comprises a die holder for removably holding one of the crimping dies 32. However, as noted above, the working head might not be adapted to receive removable dies. In that case, the movable member 50 might comprise a front end with a crimp die shape or a cutting blade shape. The connection 68 comprises a post 72 and a thrust washer 74. The post 72 has a rear end located in a hole 76 at the front end 70 of the ram 48. A nut 78 is attached to the front end of the ram to substantially close the hole 76, but the nut 78 has a hole 80 which a portion of the post 72 extends through. The nut 78 captures the rear end of the post 72 in the hole 76. The hole 80 is an oversized hole to allow the post to non-axially rotate in the hole 80. An optional spring 82 is provided to help facilitate assembly.

The thrust washer 74 has a general domed (partially spherical) shape with a flat bottom surface 86 which is located against the front end 70 of the ram 48. The thrust washer 74 has a hole 88 which a portion of the post 72 extends through. The top surface 91 of the thrust washer 74 has a general convex shape. The front end 84 of the post 72 is pivotably connected to the movable member 50 by a pivot 90. The pivot 90 could comprise a pin or fastener for example.

The movable member 50 has a rear end 92 with a concave shaped surface 94 and a side section 96 with a track section 98. The track section forms a lateral guide section slideably mounted on a portion of the frame. The surface 94 is located against the top surface 91 of the thrust washer 74. The track section 98 is slideably interlocked with a track section 100 on the side extension 64 of the frame 46. The movable member 50 can move up and down relative to the frame 46 with the track section 98 sliding along the track section 100 to retain the movable member with the frame 46. In one type of embodiment the track sections 98, 100 comprises a mating T shaped projection and slot. However, any suitable shapes could be provided.

Figure 1:
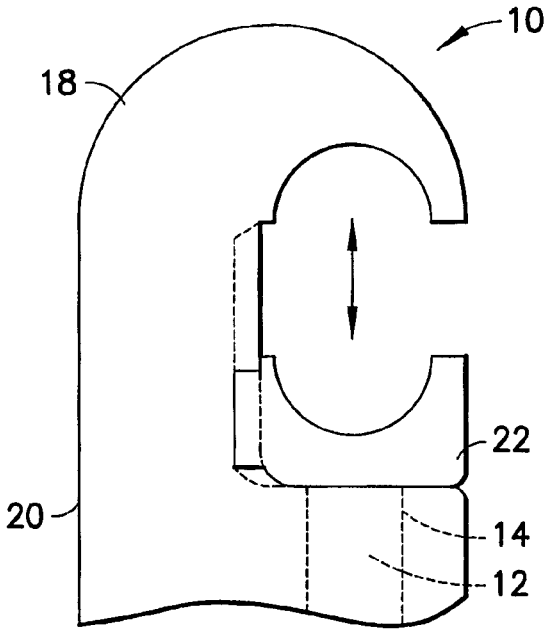
FIG. 1 PRIOR ART
FIG. 1 is a partial side view of a working head in a conventional hydraulic crimping tool.
Figure 2:
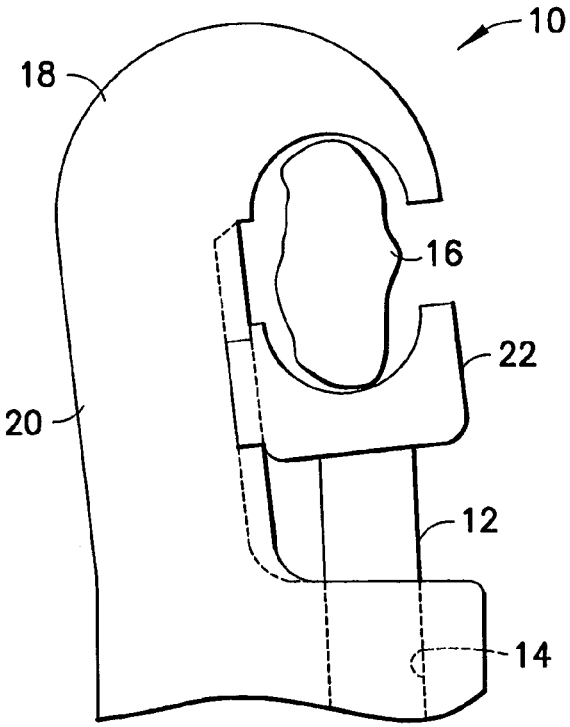
FIG. 2 PRIOR ART
FIG. 2 is a partial side view as in FIG. 1 showing deflection of the crimping head during crimping of an article.

As described above with reference to FIGS. 1 and 2, when exposed to the force from the ram during crimping of a connector, the frame 46 can bend as shown in FIG. 4. The connection 68 is adapted to allow the movable member 50 to move relative to the ram 48 to compensate for this deflection of the frame 46. The movable member 50 is adapted to move relative to the ram 48 in a second direction 51 perpendicular to the first direction 49.

It is desirable to keep the piston ram 48 axially aligned to the hydraulic cylinder axis 102. If the piston ram 48 were to tip with the die holder 50, the piston ram 48 would scoff and scrape the cylinder at contact surfaces A and B. To prevent the piston ram from tipping, the movable die holder 50 is free to translate in the X direction as well as rotate about the Z axis. The die holder 50 is forced to follow the head T track 100 as it deflects keeping the movable die holder free to move relative to the ram.

Relative movement minimizes stress, wear, etc. on the head frame 46 and movable die holder 50 T track 98. Axis 103 shows the axis of motion of the die holders with the head loaded and deflected. Clearance between the nut 78 and post 72, and the post 72 to the drilled hole 76 in the hydraulic piston ram allow the die holder 50 to translate in the X direction and rotate about the Y, Z axes. The movable die holder 50 can also rotate about the X axis. However, when assembled to the crimping head, the rotation about the x axis is extremely limited as a result of the interlocking T track. The thrust washer permits rotation about surface 94 and translation on surface 86.

The second frame member 56 of the working head is preferably adapted to rotate about the first frame member 54 about the Y axis. Rotating the crimp head at about the Y axis also causes rotation of the movable lower die holder 50 about the Y axis. When this occurs, it is desirable not to have the hydraulic piston ram seal 104 rotate. This device as portrayed allows the hydraulic piston ram 48 and seal 104 to remain stationary as the head 46 and lower die holder 50 rotate. The post 72 rotates freely within the drill hole 76 of the hydraulic piston ram 48.

Figure 6:
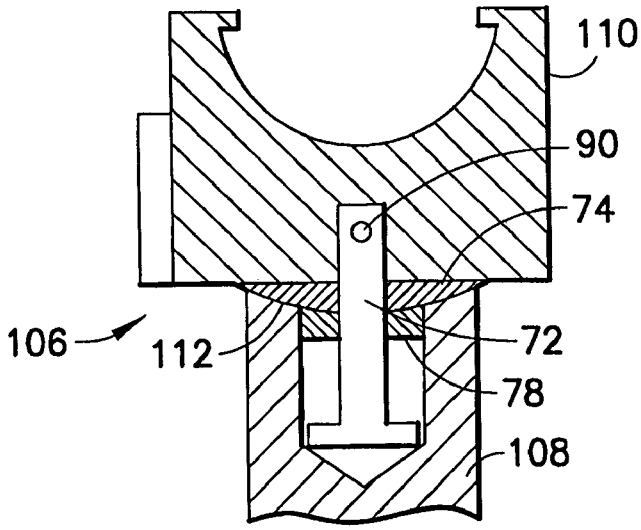
FIG. 6 is a cross sectional view of the top of the ram and the movable member of an alternate embodiment of the invention.

Referring now to FIG. 6, another embodiment of the invention is shown. In this embodiment the connection 106 between the ram 108 and the movable member 110 comprises the post 72, the nut 78, and the thrust washer 74. The front end of the ram 108 has a concave shaped surface 112; not a flat surface as with the ram 48. The movable member 110 has a flat bottom surface; not a concave surface as in the movable member 50. The thrust washer 74 is reversely orientated relative to the position of the washer shown in FIG. 5. The front end of the post 72 is pivotably connected to the movable member 110 at pivot 90.

Figure 7:
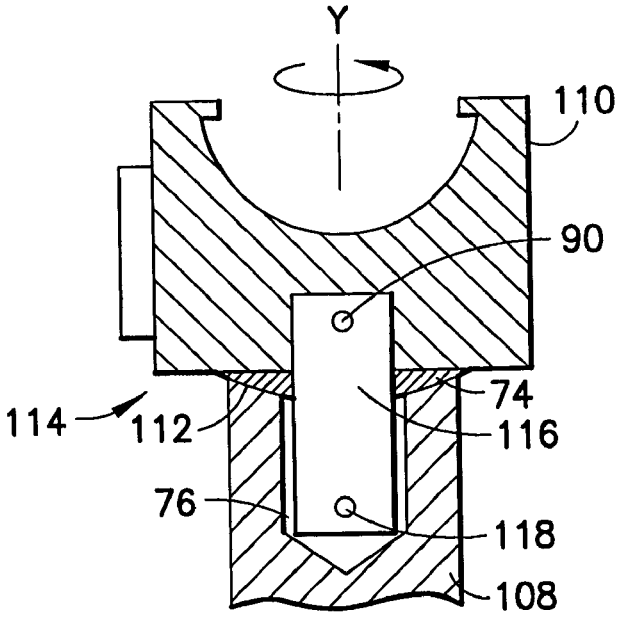
FIG. 7 is a cross sectional view of the top of the ram and the movable member of an alternate embodiment of the invention.

Referring now to FIG. 7, another embodiment of the invention is shown. In this embodiment the connection 114 between the ram 108 and the movable member 110 comprises the post 116 and the thrust washer 74. The front end of the ram 108 has a concave shaped surface 112; not a flat surface as with the ram 48. The movable member 110 has a flat bottom surface; not a concave surface as in the movable member 50. The thrust washer 74 is reversely orientated relative to the position of the washer shown in FIG. 5. The front end of the post 116 is pivotably connected to the movable member 110 at pivot 90. The rear end of the post 116 is pivotably connected to the ram 108 at pivot 118 inside the hole 76. With this embodiment the ram would need to rotate about the Y axis with the die holder.

Figure 8:
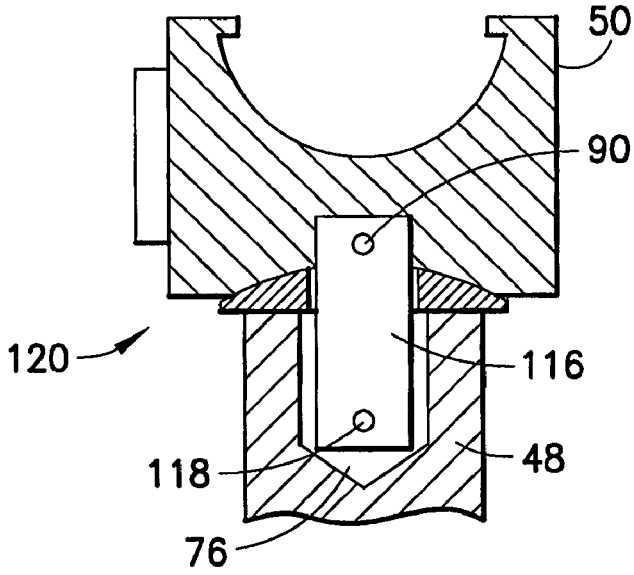
FIG. 8 is a cross sectional view of the top of the ram and the movable member of an alternate embodiment of the invention.

Referring now to FIG. 8, another embodiment of the invention is shown. In this embodiment the connection 120 between the ram 48 and the movable member 50 comprises the post 116 and the thrust washer 74. The nut 78 is not used. The front end of the post 116 is pivotably connected to the movable member 50 at pivot 90. The rear end of the post 116 is pivotably connected to the ram 48 at pivot 118 inside the hole 76. This embodiment is generally a reverse design to that shown in FIG. 7. With this embodiment the ram would need to rotate about the Y axis with the die holder.

Figure 9:
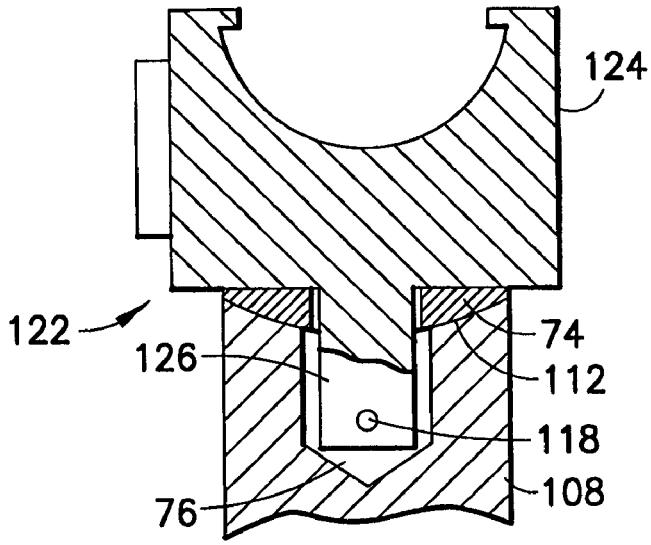
FIG. 9 is a cross sectional view of the top of the ram and the movable member of an alternate embodiment of the invention.

Referring now to FIG. 9, another embodiment of the invention is shown. In this embodiment the connection 122 between the ram 108 and the movable member 124 comprises a post section 126 of the movable member 124 and the thrust washer 74. The front end of the ram 108 has a concave shaped surface 112. The movable member 124 has a flat bottom surface except at the post section 126. The post section 126 extends in a general cantilever fashion from the bottom end of the movable member 124. The thrust washer 74 is located between the surface 112 and the bottom of the movable member with the post section 126 extending through the hole in the thrust washer. The rear end of the post section 126 is pivotably connected to the ram 108 at pivot 118 inside the hole 76. With this embodiment the ram would need to rotate about the Y axis with the die holder.

Figure 10:
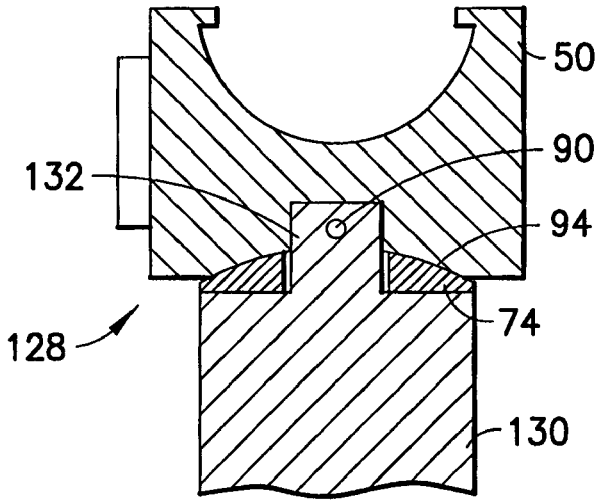
FIG. 10 is a cross sectional view of the top of the ram and the movable member of an alternate embodiment of the invention.

Referring now to FIG. 10, another embodiment of the invention is shown. In this embodiment the connection 128 between the ram 130 and the movable member 50 comprises a post section 132 of the ram 130 and the thrust washer 74. The front end of the ram 130 has a flat surface except at the post section 132. The movable member 50 has a concave shaped surface 94. The post section 132 extends in a general cantilever fashion from the top end of the ram 130. The thrust washer 74 is located between the surface 94 and the top of the ram 130 with the post section 132 extending through the hole in the thrust washer. The front end of the post section 132 is pivotably connected to the movable member 50 at pivot 90. With this embodiment the ram would need to rotate about the Y axis with the die holder.

Figure 11:
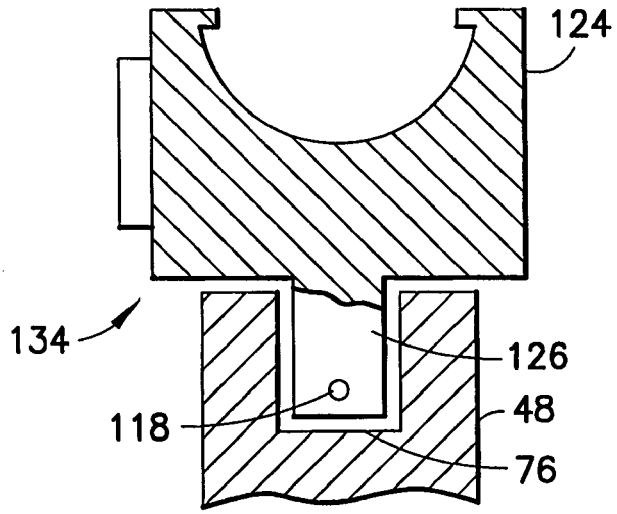
FIG. 11 is a cross sectional view of the top of the ram and the movable member of an alternate embodiment of the invention.

Referring now to FIG. 11, another embodiment of the invention is shown. In this embodiment the connection 134 between the ram 48 and the movable member 124 comprises a post section 126 of the movable member 124, but does not include a thrust washer. The front end of the ram 48 has a flat shaped surface. The movable member 124 has a flat bottom surface except at the post section 126. The post section 126 extends in a general cantilever fashion from the bottom end of the movable member 124. The rear end of the post section 126 is pivotably connected to the ram 48 at pivot 118 inside the hole 76. With this embodiment the ram would need to rotate about the Y axis with the die holder. This design allows the die holder to tip. However, it does not allow translation movement.

Figure 12:
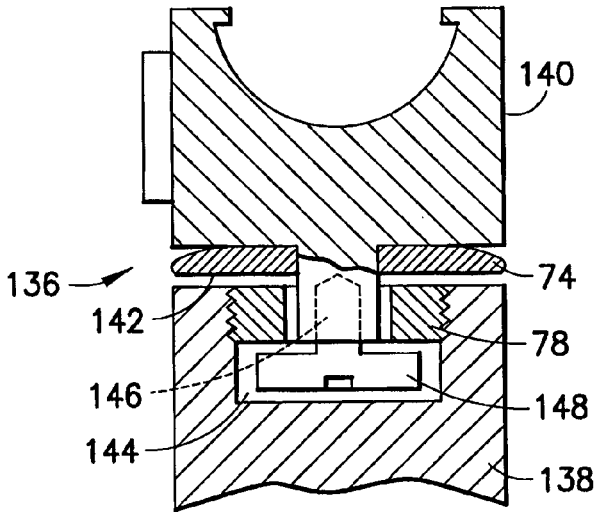
FIG. 12 is a cross sectional view of the top of the ram and the movable member of an alternate embodiment of the invention.

Referring now to FIG. 12, another embodiment of the invention is shown. In this embodiment the connection 136 between the ram 138 and the movable member 140 comprises a post section 142 of the movable member 140, the thrust washer 74. The front end of the ram 138 has a flat shaped surface, but with the hole 144 and the nut 78 screwed into the hole 144. The movable member 140 has a flat bottom surface except at the post section 142. The post section 142 extends in a general cantilever fashion from the bottom end of the movable member 140. The post section 142 extends through the hole in the thrust washer. The rear end of the post section 126 has a threaded hole 146. The connection 136 also comprises a fastener 148. The fastener 148 is screwed into the threaded hole 146. The fastener 148 has an enlarged section located behind the nut 78 to thereby retain the movable member 140 with the ram 138.

Figure 13:
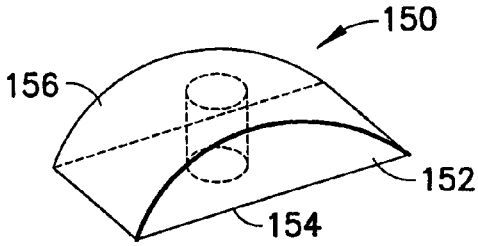
FIG. 13 is a perspective view of an alternate embodiment of the thrust washer.

Referring also to FIG. 13, an alternate embodiment of the thrust washer is shown. In this embodiment the thrust washer 150 has flat side surfaces 152 and a flat bottom surface 154, but a curved top surface 156. In another alternate embodiment, the domed thrust washer and the nut could be combined into a single member.

Figure 14:
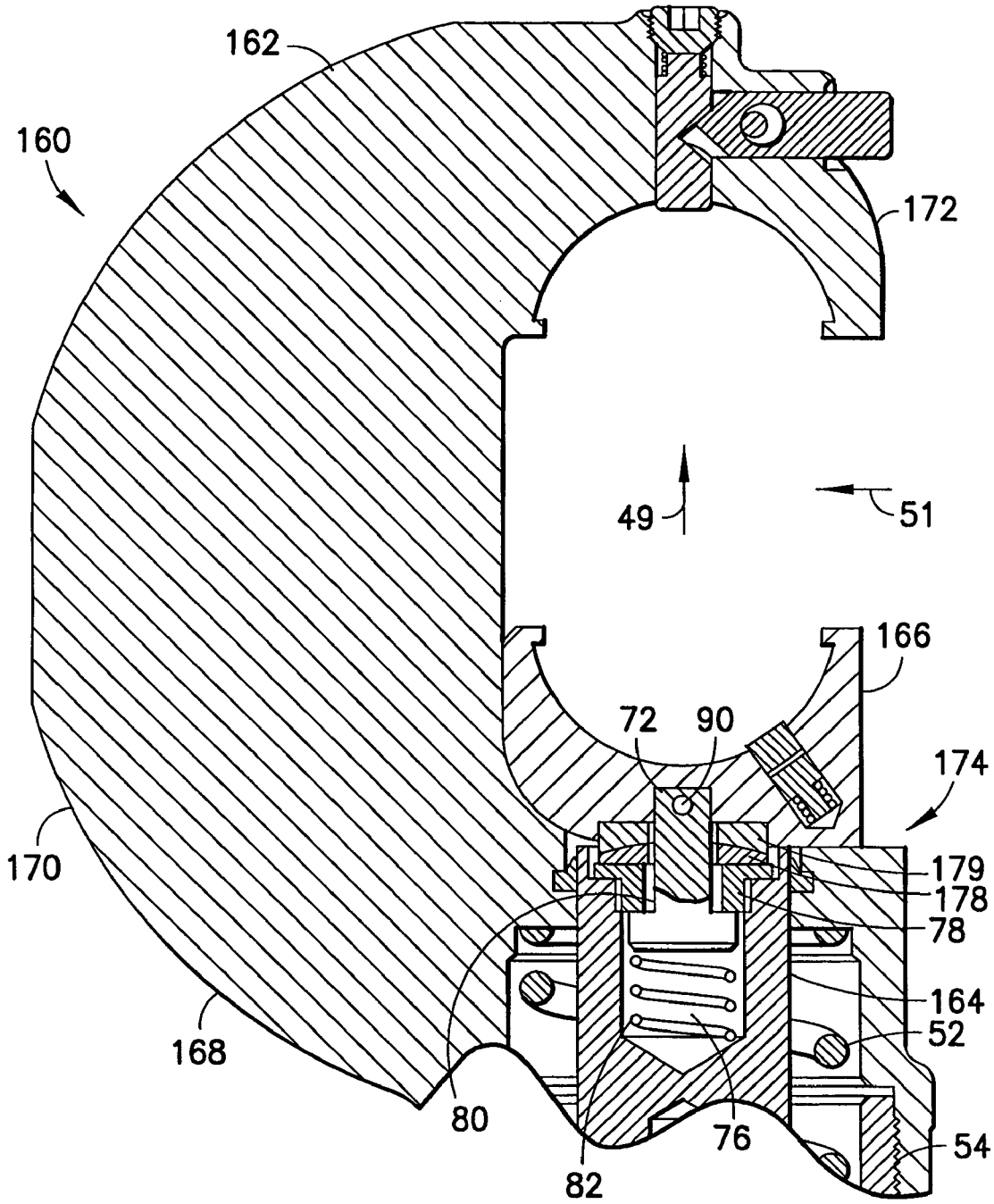
FIG. 14 is a cross sectional view of another alternate embodiment of the invention.

Referring now to FIG. 14, another embodiment is shown. In this embodiment the hydraulic tool working head 160 comprises a frame 162, a ram 164, a movable member 166 connected to the ram 164, and a spring 52. The frame 162 comprises a first frame member 54 fixedly connected to a frame of the fluid conduit system of the rest of the tool and a second frame member 168. The second frame member 168 comprises a general C shaped profile. However, in alternate embodiments other types of shapes could be provided. The bottom end of the C shaped profile is mounted to the first frame member 54. The C shaped profile comprises a side extension 170 and a top section 172. The top section 172 forms an upper die holder located opposite the ram 164. The ram 164 is adapted to move the movable member 166 towards and away from the top section 172.

A connection 174 is provided between the front end of the ram 164 and a rear end of the movable member 166. The connection 174 is an automatic adjusting connection. The movable member 166 comprises a die holder for removably holding one of the crimping dies 32 (see FIG. 3). However, as noted above, the working head might not be adapted to receive removable dies. In that case, the movable member might comprise a front end with a crimp die shape or a cutting blade shape. The connection 174 comprises a post 72 and a pair of thrust washers 178, 179. The front end of the post 72 is pivotably connected to the movable member 166 by a pivot 90. The pivot 90 could comprise a pin or fastener for example. The post 72 has a rear end located in a hole 76 at the front end of the ram 164. A nut 78 is attached to the front end of the ram to substantially close the hole 76, but the nut 78 has a hole 80 which a portion of the post 72 extends through. The nut 78 captures the rear end of the post 72 in the hole 76. The hole 80 is an oversized hole to allow the post to non-axially rotate in the hole 80. The post 72 can also axially rotate in the hole 80. An optional spring 82 is provided to help facilitate assembly.

The pair of thrust washers 178, 179 are two-piece spherical washers, such as made of steel or stainless steel. The bottom washer 178 has a flat bottom side and a dome shaped top side. The bottom side of the bottom washer 178 can sit on the top side of the nut 78. The top washer 179 has a flat top side and a concave shaped bottom side. The bottom side of the top washer 179 is sized and shaped to mate with the dome shaped top side of the bottom washer 178. The bottom of the movable member 166 can have a recess to receive and seat the top side of the top washer 179. Preferably, both the ram and the movable member are counter-bored. The function is still the same because the lower spherical washer can still translate and allows the movable member to rotate. Two-piece spherical washers can be purchased as off-the-shelf items, thereby making the working head 160 less expensive to manufacture.

As described above with reference to FIGS. 1 and 2, when exposed to the force from the ram during crimping of a connector, the frame can bend. The connection 174 is adapted to allow the movable member 166 to move relative to the ram 164 to compensate for this deflection of the frame 162. The movable member 166 is adapted to translate relative to the ram 165 in a second direction 51 perpendicular to the first direction 49, as well as rotate relative to the ram.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A hydraulic tool working head comprising:

a frame;

a ram movably connected to the frame in a first longitudinal direction, wherein the ram is adapted to be moved relative to the frame by hydraulic fluid; and a movable member connected to a first end of the ram by an automatic adjusting connection, wherein the movable member is adapted to move relative to the ram in a second direction perpendicular to the first direction, wherein the automatic adjusting connection comprises a post and a first end of the post is pivotably connected to the ram.

2. A hydraulic tool working head as in claim 1 wherein the automatic adjusting connection comprises a movable thrust washer on the first end of the ram between the first end of the ram and a rear end of the movable member.

3. A hydraulic tool working head as in claim 1 wherein the post has a second end pivotably connected to the movable member, wherein the post is pivotably connected to the ram.

4. A hydraulic tool working head as in claim 3 wherein the automatic adjusting connection comprises a nut attached to the first end of the ram and having an oversized hole which the post extends through, wherein the hole is larger than the post to allow the post to laterally move in the hole.

5. A hydraulic tool working head as in claim 3 wherein the first end of the post extends into a hole in the first end of the ram.

6. A hydraulic tool working head as in claim 1 wherein the first end of the post is spring biased in the hole.

7. A hydraulic tool working head as in claim 2 wherein the thrust washer comprises a curved top surface.

8. A hydraulic tool working head as in claim 7 wherein the thrust washer comprises a substantially flat opposite bottom surface.

9. A hydraulic tool working head as in claim 2 wherein the thrust washer comprises a hole with a post of the automatic adjusting connection extending therethrough.

10. A hydraulic tool working head as in claim 2 wherein the thrust washer comprises a curved bottom surface and the first end of the ram comprises a concave shape.

11. A hydraulic tool working head as in claim 1 wherein the automatic adjusting connection comprises two-piece spherical washers.

12. A hydraulic tool comprising:

a main section comprising a pump and a hydraulic fluid reservoir;

a hydraulic tool working head as in claim 1 connected to the main section.

13. A hydraulic tool working head comprising:

a frame;

a ram movably connected to the frame in a first longitudinal direction, wherein the ram is adapted to be moved relative to the frame by hydraulic fluid; and a movable member connected to a first end of the ram by an automatic adjusting connection, wherein the movable member is adapted to move relative to the ram in a second direction perpendicular to the first direction, and wherein the movable member comprises a compression die holder.

14. A hydraulic tool working head comprising:

a frame;

a ram movably connected to the frame in a first longitudinal direction, wherein the ram is adapted to be moved relative to the frame by hydraulic fluid; and a movable member connected to a first end of the ram by an automatic adjusting connection, wherein the movable member is adapted to move relative to the ram in a second direction perpendicular to the first direction, and wherein the movable member comprises a lateral guide section slideably mounted on a portion of the frame.

15. A hydraulic tool working head as in claim 14 wherein the lateral guide section and the portion of the frame comprise a mating T shaped projection and recess.

16. A hydraulic tool working head comprising:

a frame;

a ram movably connected to the frame in a first longitudinal direction, wherein the ram is adapted to be moved relative to the frame by hydraulic fluid; and a movable member connected to a first end of the ram by an automatic adjusting connection, wherein the movable member is adapted to move relative to the ram in a second direction perpendicular to the first direction, and wherein the automatic adjusting connection comprises the movable member being adapted to rotate along a first axis perpendicular to the first direction.

17. A hydraulic tool working head as in claim 16 wherein the automatic adjusting connection comprises the movable member being adapted to rotate along a second axis perpendicular to the first axis.

18. A hydraulic tool working head comprising:

a frame;

a ram movably connected to the frame in a first longitudinal direction, wherein the ram is adapted to be moved relative to the frame by hydraulic fluid; and a movable member connected to a first end of the ram by an automatic adjusting connection, wherein the movable member is adapted to rotate along an axis perpendicular to the first direction and translate in a second different direction, wherein the movable member comprises a compression die holder.

19. A method of manufacturing a hydraulic tool working head comprising:

connecting a ram to a frame, wherein the ram is adapted to be moved relative to the frame in a first longitudinal direction by hydraulic fluid; and connecting a movable member to a front end of the ram with an automatic adjusting connection, wherein the movable member is adapted to move relative to the ram in a second direction perpendicular to the first direction, wherein the automatic adjusting connection comprises a post and a first end of the post is pivotably connected to the ram.

* * * * *